US006218779B1

(12) United States Patent
Cho

(10) Patent No.: US 6,218,779 B1
(45) Date of Patent: Apr. 17, 2001

(54) METHOD FOR FABRICATING PARTITIONS OF PLASMA DISPLAY DEVICE AND PLASMA DISPLAY DEVICE HAVING SAID PARTITION FABRICATED THEREBY

(75) Inventor: Jong-ho Cho, Kwacheon (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/176,764

(22) Filed: Oct. 22, 1998

(30) Foreign Application Priority Data

Oct. 22, 1997 (KR) ..... 1997-54209

(51) Int. Cl.[7] ..... H01J 17/49

(52) U.S. Cl. ..... 313/584; 430/29; 430/54; 430/117; 430/198; 445/24

(58) Field of Search ..... 445/24; 313/584; 430/198, 29, 54, 117

(56) References Cited

U.S. PATENT DOCUMENTS 4,959,295 * 9/1990 Nebe et al. ..... 430/281
5,116,271 * 5/1992 Arimoto ..... 445/24
5,209,688 * 5/1993 Nishigaki et al. ..... 445/24
5,765,545 * 7/1998 Yoshiba et al. ..... 427/356
5,972,548 * 10/1999 Landa et al. ..... 430/47
6,113,449 * 9/2000 Sung et al. ..... 445/24
6,117,612 * 9/2000 Halloran et al. ..... 430/269
6,117,614 * 9/2000 Takahashi et al. ..... 430/270.1
6,120,975 * 9/2000 Tokai et al. ..... 430/198
6,132,937 * 10/2000 Suzuki ..... 430/285.1

* cited by examiner

*Primary Examiner*—Kenneth J. Ramsey
(74) *Attorney, Agent, or Firm*—Lowe Hauptman Gilman & Berner, LLP

(57) ABSTRACT

A partition of a plasma display device is fabricated by forming a dielectric layer on the surface of a rear substrate having an address electrode; forming a conductive layer and a photoconductive layer in order on the surface of said dielectric layer; charging the surface of said photoconductive layer; exposing aid photoconductive layer covered with a mask of a predetermined pattern to ultraviolet rays so that an electrostatic latent image can be formed on said photoconductive layer; developing the electrostatic latent image by allowing said photoconductive layer, on which the electrostatic latent image is formed, to be in contact with a charged liquid toner layer so that liquid toner can stick to the electrostatic latent image; drying the toner stuck to the electrostatic latent image and absorbing the toner remaining an area other than the electrostatic latent image; repeating three times the steps from said step of charging the surface of said photoconductive layer through to said step of drying and absorbing the toner; and burning the rear substrate where partitions are formed.

22 Claims, 5 Drawing Sheets

METHOD FOR FABRICATING PARTITIONS OF PLASMA DISPLAY DEVICE AND PLASMA DISPLAY DEVICE HAVING SAID PARTITION FABRICATED THEREBY

BACKGROUND OF THE INVENTION

1. Field of the Invention

The present invention relates to a method for fabricating partitions of a plasma display device and a plasma display device having the partitions fabricated thereby, and more particularly, to a method for fabricating partitions on a rear substrate of a plasma display device using an electrophotography method and a plasma display device having the partitions fabricated thereby.

2. Description of the Related Art

Plasma display devices displaying an image by gas discharge have been known to have superior performances in display capacity, brightness, contrast, a latent image, and a viewing angle, and thus highlighted as a display panel that can replace the conventional CRTs in the future. In the plasma display device, gas discharge is generated between electrodes by direct-current (DC) or alternatingcurrent (AC) voltage applied to the electrodes and then the gas radiates ultraviolet rays so that light is emitted by fluorescent substance excited by the ultraviolet rays. The plasma display device can be classified into an AC type and a DC type according to a discharge mechanism.

FIG. 1 is an exploded perspective view showing the structure of a general AC type plasma display device.

Referring to the drawing, a first electrode 13*a* which is a transparent display electrode and a second electrode 13*b* which is an address electrode are formed between a front glass substrate 11 and a rear glass substrate 12. The first and second electrodes 13*a* and 13*b* are formed in strips on the inner surfaces of the front and rear glass substrates 11 and 12, respectively, and are crossed each other when the substrates 11 and 12 are assembled. A dielectric layer 14 and a protective layer 15 are deposited in order on the inner surface of the front glass substrate 11. The rear glass substrate 12 has a dielectric layer 14' formed thereon and partitions 17 are formed on the dielectric layer 14'. A cell 19, a space for filling inert gas such as argon (Ar), is formed between the partitions 17. The partitions 17 are coated with fluorescent material 18 as shown in the drawing.

To operate the plasma display device having the above structure, high voltage, called a trigger voltage, is applied to generate discharge between the electrodes 13*a* and 13*b*. The discharge is generated when cations are stored in the dielectric layer 14 by the trigger voltage. When the trigger voltage exceeds a threshold voltage, the argon gas filling the cell 19 is transformed into a plasma state due to the discharge and a stable discharge state is maintained between the electrodes 13*a* and 13*b*. In the stable discharge state, ultraviolet rays of light emitted during the discharge collides against the fluorescent material 18 to emit light. Accordingly, each pixel formed in an unit of a cell can display an image.

FIG. 2 is a perspective view illustrating a blade coater. The blade coater is one of apparatuses used to fabricate partitions of a plasma display device using a conventional printing method.

Referring to the drawing, a mesh (not shown) is attached on the upper surface of a rear substrate 21 on which the address electrode and the dielectric layer are already formed in the previous process. A blade 22 is installed at the lower portion of a support bar 23. The support bar 23 can horizontally move above the rear substrate 21. The blade 22 horizontally moves while pressing material for the partitions in a paste state placed on the mesh attached to the rear substrate 21 so that the partition material can be uniformly coated on the surface of the dielectric layer of the rear substrate 21.

However, the fabrication of the partition using the blade coater according to the conventional printing method as above causes the following problems.

First, the blade coater printing operation should be repeated several times until the height of the partition having a predetermined width is obtained, during which each printing operation necessitates a drying operation. If the height of a complete partition is about 200 $\mu$m, the printing operation and the drying operation should repeat at least ten times. Thus, the time needed for fabricating the partition gets longer, e.g., one hour or more is required per substrate. Such delay in the fabrication process causes lowering of productivity.

Another problem is that, when the blade presses the partition material in a paste state against the surface of the substrate, the mesh attached on the substrate is deformed due to pressure of the blade. Since the mesh functions to maintain a pattern of the partitions, the deformation of the mesh critically effects the fabrication of the partition according to the designed pattern. That is, the shape of a finally completed partition can be deformed, thereby deteriorating the quality of products.

SUMMARY OF THE INVENTION

To solve the above problems, it is an objective of the present invention to provide a method for fabricating partitions of a plasma display device by an electrophotography method.

It is another objective of the present invention to provide a plasma display device having the partitions fabricated by the electrophotography method.

Accordingly, to achieve the objective of the present invention, there is provided a method for fabricating partitions of a plasma display device comprising the steps of, forming a dielectric layer on the surface of a rear substrate having an address electrode, forming a conductive layer and a photoconductive layer in order on the surface of the dielectric layer, charging the surface of the photoconductive layer, exposing the photoconductive layer covered with a mask of a predetermined pattern to ultraviolet rays so that an electrostatic latent image can be formed on the photoconductive layer, developing the electrostatic latent image by allowing the photoconductive layer, on which the electrostatic latent image is formed, to be in contact with a charged liquid toner layer so that liquid toner can stick to the electrostatic latent image, drying the toner stuck to the electrostatic latent image and absorbing the toner remaining an area other than the electrostatic latent image, repeating three times the steps from the step of charging the surface of the photoconductive layer through to the step of drying and absorbing the toner, and burning the rear substrate where partitions are formed.

It is preferable in the present invention that the dielectric layer is formed of silicate having silicon dioxide as a main ingredient, that the conductive layer is formed by coating an alcoholic solution including ammonium salt on the surface of the dielectric layer and then drying the same, and that the thickness of the conductive layer is formed to be 1 $\mu$m.

It is also preferable in the present invention that the photoconductive layer is formed by coating a composite including a fluorene-based donor, an anthraquinone-based acceptor, a polyacrylate-based binder, and toluene, and then drying the same and that the composition ratio of the fluorene-based donor, the anthraquinone-based acceptor, and the polyacrylate-based binder is at the weight ratio of 5:15:85.

It is further preferable in the present invention that the thickness of the photoconductive layer is between 5–6 $\mu$m, that, in repeating the exposure step three times, a mask having a chromium pattern is used for the first exposing step and the second and third exposing steps are performed without a mask, that the mask is disposed spaced apart about 0.5 mm or less from the surface of the photoconductive layer in the first exposing step, that, in the developing step, liquid toner flowing in a laminar flow state on the surface of an electrode to which current is applied is allowed to be in contact with the photoconductive layer where the electrostatic latent image is formed so that the charged liquid toner is stuck to the electrostatic latent image, and that the distance between the electrode and the photoconductive layer is kept between 0.5–1 mm.

It is further preferable in the present invention that the liquid toner is a composition including frit, that is a mixture of metal oxide, a binder, and a solution, that the liquid toner is formed by mixing the frit and the binder at 3:7 weight ratio and by mixing a mixture of the frit and the binder with the solution at the weight ratio of 1:20, and that the binder is polymetacrylic acid and the solution is isoparffin liquid.

It is further preferable in the present invention that the frit of the liquid toner includes different metal oxide components each repeated time of the three-time repetition steps, i.e., the frit of the liquid toner includes lead oxide, manganese oxide, and zinc oxide for the first repetition, lead oxide, copper oxide, manganese oxide, and chromium oxide for the second repetition, and lead oxide, di-boron trioxide, and aluminum oxide for the third repetition.

It is further preferable in the present invention that the frit of the liquid toner for the first repetition includes lead oxide, manganese oxide, and zinc oxide of 30:40:30 wt %, that the frit of the liquid toner for the second repetition includes lead oxide, copper oxide, manganese oxide, and chromium oxide of 30:25:30:15 wt %, and that the frit of the liquid toner for the third repetition includes lead oxide, di-boron trioxide, and aluminum oxide of 35:25:40 wt %.

Further, according to another aspect of the present invention, there is provided a plasma display device fabricated by forming a dielectric layer on the surface of a rear substrate having an address electrode, forming a conductive layer and a photoconductive layer in order on the surface of the dielectric layer, charging the surface of the photoconductive layer, exposing the photoconductive layer covered with a mask having a predetermined pattern to ultraviolet rays so that an electrostatic latent image can be formed on the photoconductive layer, developing the electrostatic latent image by allowing the photoconductive layer, on which the electrostatic latent image is formed, to be in contact with a charged liquid toner layer so that liquid toner can stick to the electrostatic latent image, drying the toner stuck to the electrostatic latent image and absorbing the toner remaining an area other than the electrostatic latent image, repeating three times the steps from the step of charging the surface of the photoconductive layer through to the step of drying and absorbing the toner, and burning the rear substrate where partitions are formed.

It is preferable in the present invention that the liquid toner is a composite including frit, that is a mixture of metal oxide, a binder, and a solution, the frit of the liquid toner includes different metal oxide components each repeated time of the three-time repetition step, and a completed partition has different thermal expansion coefficients according to its height so that the difference of amount of deformation due to thermal expansion can be accommodated.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 8:
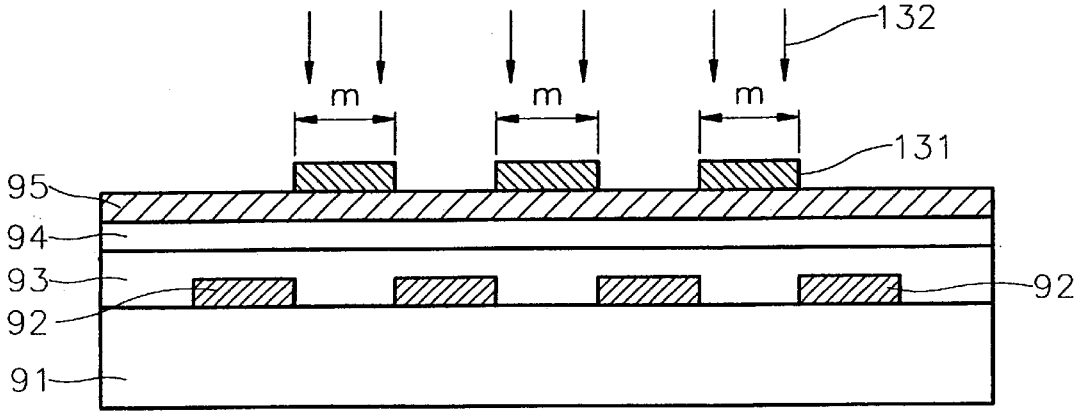
FIG. 8 is a sectional view showing the step of light-exposing the entire surface of the photoconductive layer having partitions fabricated in the previous development step according to the embodiment of the present invention.

FIG. 8 shows the process of fabricating partitions of a plasma display device according to a preferred embodiment of the present invention. Referring to the drawing, the method according to the embodiment of the present invention is achieved by forming a dielectric layer on a rear substrate where an address electrode is formed (81), forming a conductive layer on the surface of dielectric layer (82), forming a photoconductive layer on the conductive layer (83), charging the surface of the photoconductive layer (84), light-exposing the charged photoconductive layer (85), developing an electrostatic latent image formed through the above exposure by contacting liquid toner thereto (86), drying the liquid toner stuck to the electrostatic latent image and simultaneously absorbing and exhausting the toner remaining in a portion other than the electrostatic latent image (87), repeating the above steps from 84 to 87 using other kinds of toner exhibiting different characteristics (88), and burning the substrate to fix a partition formed in the above steps on the dielectric layer (89). A subsequent step 90 follows the burning step (89).

Figure 4:
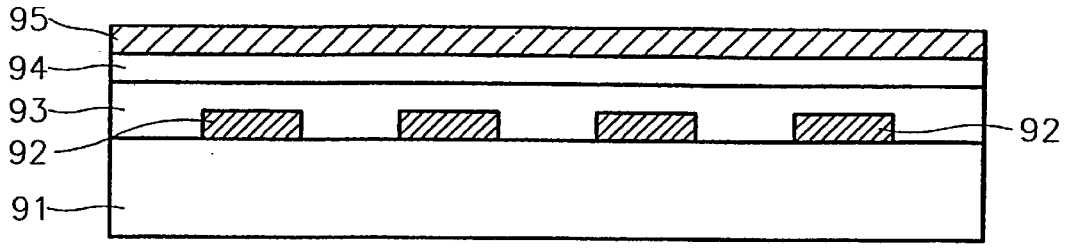
FIG. 4 is a sectional view showing a conductive layer and a photoconductive layer formed on a rear substrate according to the embodiment of the present invention.

FIG. 4 shows a conductive layer and a photoconductive layer which is formed on a surface of a rear substrate having an electrode and a dielectric layer formed thereon. Referring to the drawing, an address electrode 92 is formed on a rear substrate 91 in a conventional manner, i.e., an address electrode of ITO material is formed the inner surface of the rear substrate 91 by a photolithography method. Next, material for a dielectric layer 93 is coated on the entire surface of the rear substrate 91 and the coated surface is dried. The material for forming the dielectric layer 93 can be coated using a common spin coating method or a printing method. The dielectric layer 93 can be formed of the same material used in the conventional technology. For instance, silicate mainly comprising common silicon dioxide is used for forming the dielectric layer 93.

A conductive layer 94 and a photoconductive layer 95 are sequentially formed on the upper surface of the dielectric layer 93. The conductive layer 94 can be formed by coating and drying alcohol solution including ammonium salt using a conventional spin coating method . The thickness of the conductive layer 94 is preferably about 1 $\mu$m.

A solution for forming the photoconductive layer 95 may be made by mixing a toluene solution with a composition comprising a fluorene-based donor, an anthraquinone-based acceptor, and a polyacrylate-based binder. A preferable ratio of the above composition among the donor, the acceptor, and the binder is at the weight ratio of 5:15:85. The photoconductive layer 95 is formed by spin-coating and drying the mixture solution. The thickness of the photoconductive layer 95 after spin-coating is preferably about 5–6 $\mu$m. The description of FIG. 9 corresponds to the steps 81–83.

Figure 1:
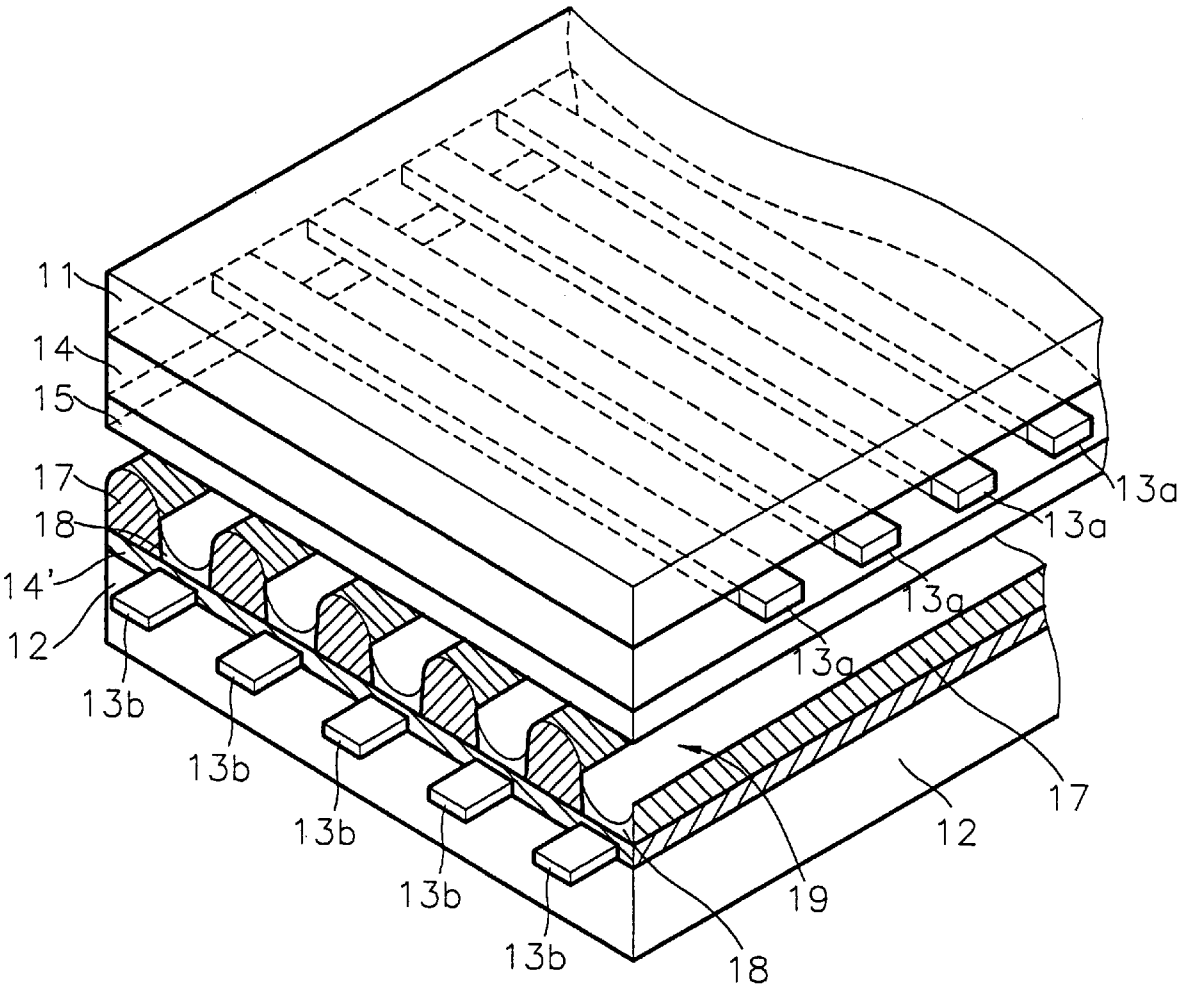
FIG. 1 is a perspective view illustrating a general plasma display device.
Figure 2:
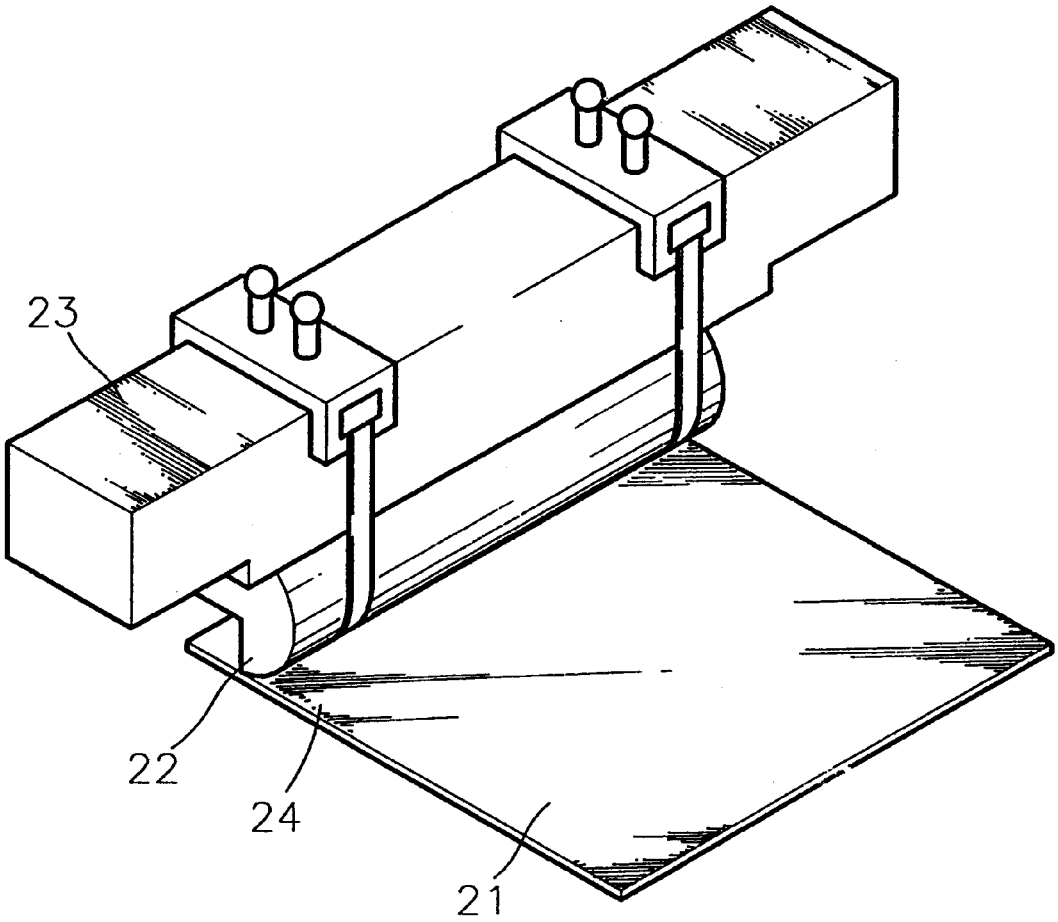
FIG. 2 (PRIOR ART)
FIG. 2 is a perspective view illustrating the blade coater for forming partitions according to the conventional printing method.
Figure 3:
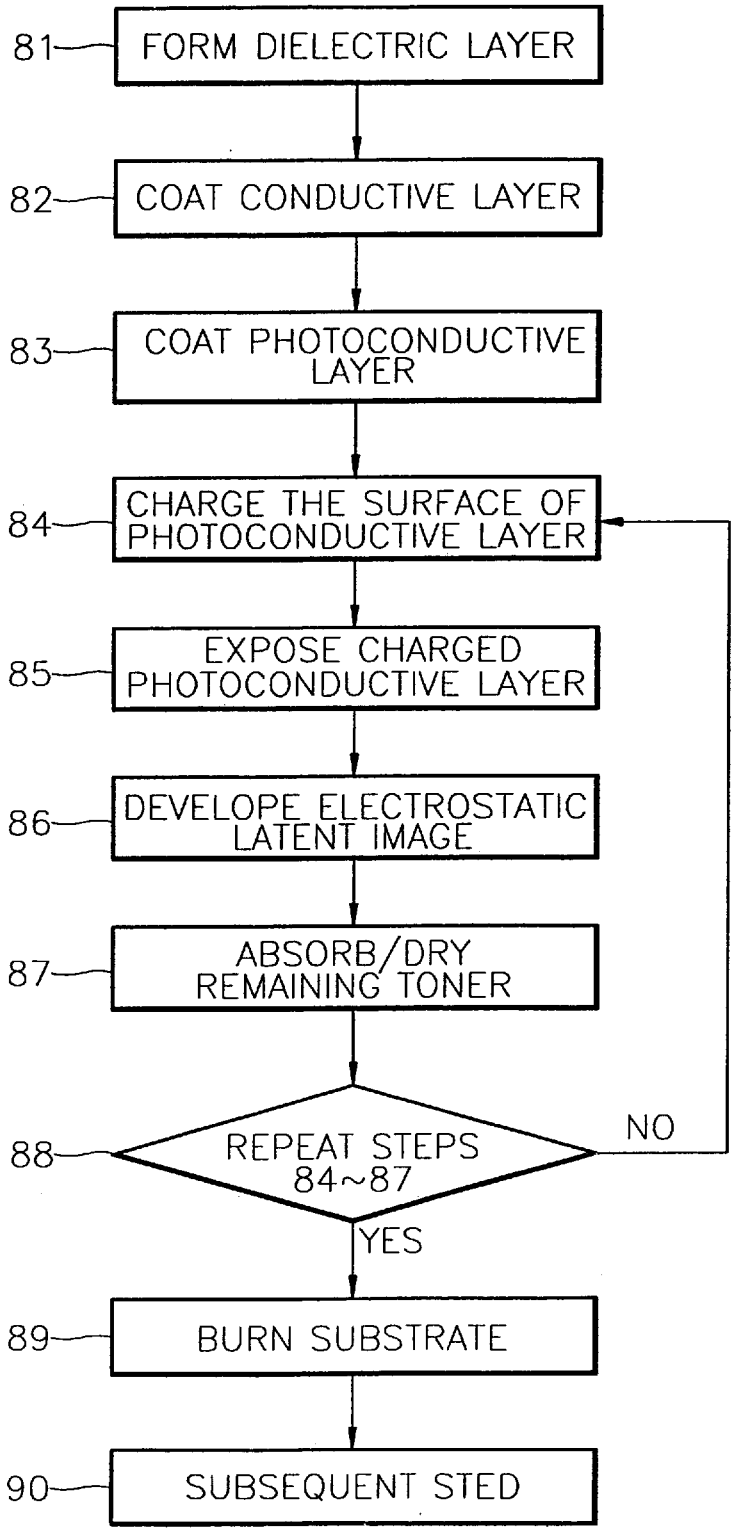
FIG. 3 is a flow chart showing the steps of fabricating partitions of a plasma display device according to a preferred embodiment of the present invention.
Figure 5:
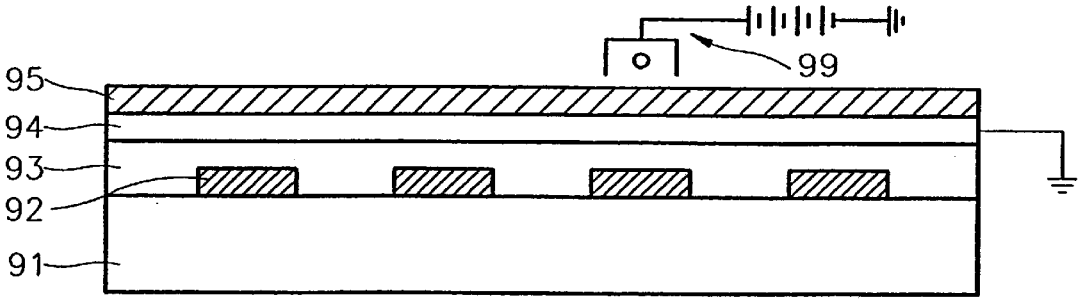
FIG. 5 is a sectional view showing the step of charging a surface of the photoconductive layer according to the embodiment of the present invention.

FIG. 5 shows a state in which the surface of the photoconductive layer is charged. Referring to the drawing, the entire surface of the photoconductive layer 95 is charged with plus electricity using tungsten wire or scrotron 99. Here, the conductive layer 94 maintains a grounded state. Such a step corresponds to step 84 in FIG. 3.

Figure 6:
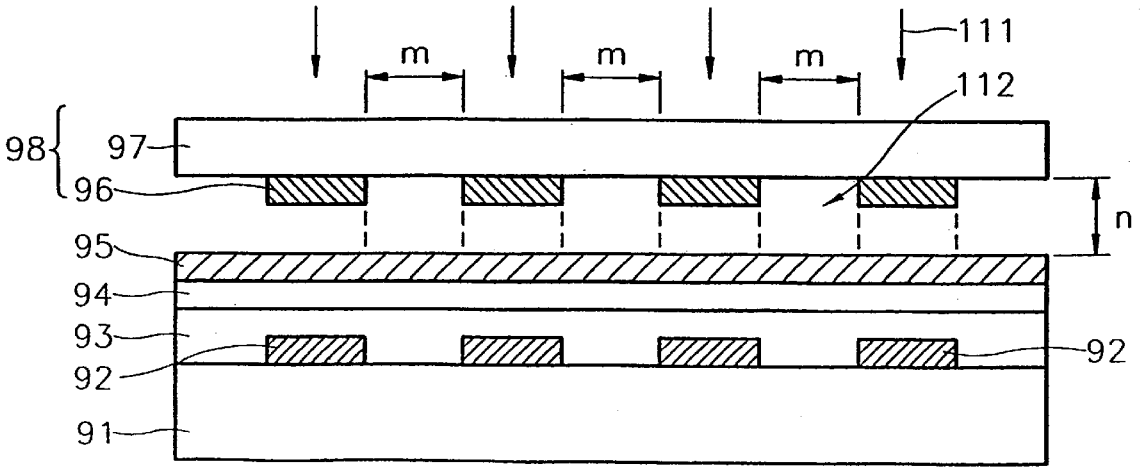
FIG. 6 is a sectional view showing the step of exposing the charged photoconductive layer to ultraviolet rays according to the embodiment of the present invention.

FIG. 6 shows a step in which an electrostatic latent image of a predetermined pattern is formed on the photoconductive layer using a mask. Referring to the drawing, a mask 98 for exposure is disposed spaced a predetermined distance from the surface of the photoconductive layer 95. The mask 98 is manufactured by forming a pattern 96 on the surface of glass 97 using chromium material. The chromium pattern 96 corresponds to the pattern of partition to be formed later and blocks ultraviolet rays for exposure. Reference numerals m and n in FIG. 6 indicate the interval in the chromium pattern 96 and the distance between the surface of photoconductive layer 95 and the mask 98, respectively. Preferably, exposure is made in a state in which n is under 0.5 mm and light 111 emitted through the mask 98 is ultraviolet rays including wavelength of 365 nm.

When the ultraviolet rays 111 is emitted while the mask 97 covers the photoconductive layer 95, plus electric charges are removed from the surface of the photoconductive layer 95 except for an area where the ultraviolet rays 111 is cut off by the chromium pattern 96 so that an electrostatic latent image of a predetermined pattern may be formed. That is, plus electric charges are removed from a portion indicated by reference numeral 112, which corresponds to a portion where the partition is to be formed on the surface of the dielectric layer 93. The removed charges by the ultraviolet rays 111 flow through the conductive layer 94 formed below the photoconductive layer 95. That is, the conductive layer 94 is to remove charges when an electrostatic latent image is formed in the exposure step. The description with reference to FIG. 6 corresponds to step 85 in FIG. 3.

Figure 7:
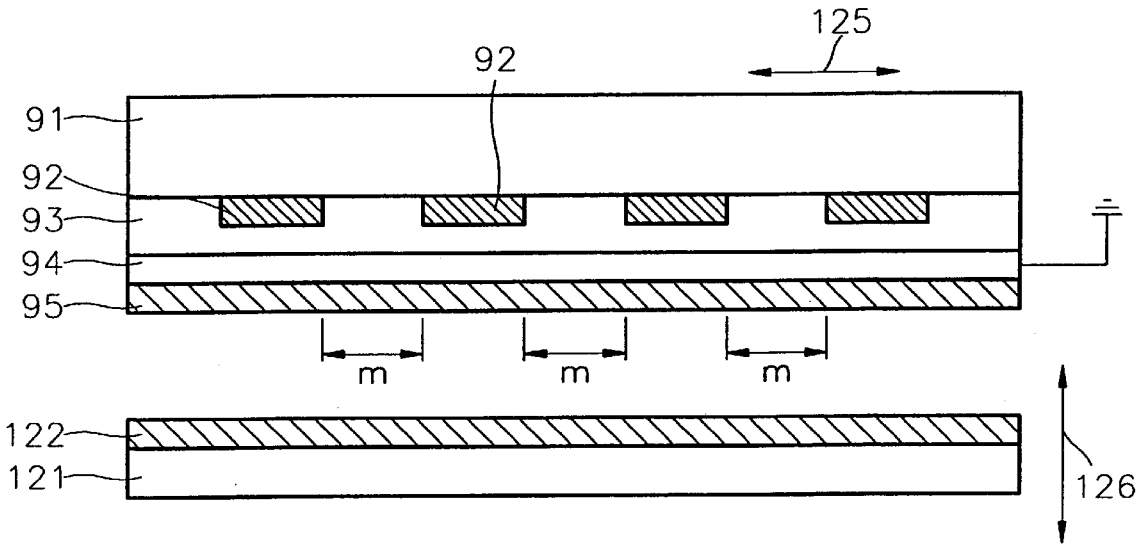
FIG. 7 is a sectional view showing the step of development by attaching liquid toner to an electrostatic latent image according to the embodiment of the present invention.

FIG. 7 shows a step in which the surface of the photoconductive layer 95 having the electrostatic latent image is developed using liquid toner. Referring to the drawing, liquid toner 122 is charged with plus electricity by flowing in a laminar flow state on the surface of a lower electrode 121 to which current is applied. The photoconductive layer 95 having the electrostatic latent image formed thereon and the lower electrode 121 are spaced a predetermined distance from each other. The rear substrate 91 is capable of horizontally reciprocating by a transferring apparatus (not shown) as indicated by a double-headed arrow 125. The lower electrode 121 is capable of vertically reciprocating by a elevating apparatus (not shown) as indicated by a double-headed arrow 126. In an actual development, as the lower electrode 121 rises toward the photoconductive layer 95 of the rear substrate 91, the gap formed between the photoconductive layer 95 and the lower electrode 71 is filled with liquid toner 72. Here, the distance between the photoconductive layer 95 and the lower electrode 71 is preferably maintained within about 0.5–1 mm.

As mentioned above, the liquid toner is stuck to the electrostatic latent image by making the liquid toner in the state of laminar flow to contact the electrostatic latent image formed on the photoconductive layer 95. The liquid toner in use is a composition comprising frit material including one or more metal oxide, a binder and a solution. The composition of the metal oxide of the frit material included in the liquid toner is selected differently every development step repeating three times. In liquid toner used for the initial development, the frit which is a composition of the metal oxide and the binder are mixed at a weight ratio of 3:7 and the mixture of the frit and the binder is mixed with a isoparaffin solution at the weight ratio of 1:20. Preferably, the binder is polymetacrylic acid and the frit comprises PbO, MnO, and ZnO at the ratio of 30:40:30 wt %. The description with reference to FIG. 7 corresponds to step 86 in FIG. 8.

After the development step is completed, a step of absorbing and drying liquid toner remaining on the photoconductive layer 95 is performed. Due to an electrostatic force, the liquid toner is stuck to the electrostatic latent image of the photoconductive layer 95 and is dried so that the image is fixed. Here, liquid toner stuck to a portion other than the area for the electrostatic latent image is absorbed using vacuum to be removed. The above description corresponds to step 87.

Referring to FIG. 3 again, the steps 84 through 87 are repeated several times including the initial step described above, preferably repeated three times. That is, after the initial development and absorbing/drying steps are completed, the steps of charging the surface of the substrate, performing exposure and development, and absorbing/drying are repeated two times.

The second and third surface charging steps are the same as the description with reference to FIG. 5. That is, the surface of the photoconductive layer 93 is charged to a predetermined electric potential using the tungsten wire or scrotron 99. When the surface having the partition formed in the initial developing step is charged, the upper surface of the partition has the highest electric potential, the side surface thereof has the next highest electric potential, and the surface of the photoconductive layer 95 where no partition is formed has the lowest electric potential.

The second and third exposure steps 85 can be performed using the mask 97 as in the initial exposure step shown in FIG. 6, or performed without the mask.

FIG. 8 shows a state in which the second and third exposure steps are performed without the mask. Referring to the drawing, ultraviolet rays are emitted onto the surface of the photoconductive layer 95 having a partition 131 formed in the previous development step. Here, when the exposure step is performed without a mask, not the charges on the surface of the partition 131 but those on the surface of the photoconductive layer 95 on which the partition 131 is not formed only are removed. This is because there is no exit for removed charges since the partition material itself serves as an insulator.

In each of the development steps three times, the composition of frit included in liquid toner differs step to step. The composition of frit of the liquid toner applied to the initial development step is the same as in the above description. Whereas the frit composition for the second development step is PbO, CuO, MnO, and CrO at the ratio of 30:25:30:15 wt % and that for the third development step is PbO, $B_2O_3$, and $Al_2O_3$ at the ratio of 35:25:40 wt %. Such different compositions are for preventing occurrence of cracks when the completed partition will be deformed due to thermal expansion. That is, since a degree of deformation due to thermal expansion varies according to the height of the partition, the difference of degrees of deformation due to thermal expansion according to the heights can be accommodated by applying frits having different thermal expansion coefficients.

A burning step follows the three-time repetition of the steps from the surface charging step to the absorbing/drying step. The heat applied during the burning step consequently eliminates all the substance for binder included in the partition material and the conductive layer 94 and the photoconductive layer 95 formed above the surface of the dielectric layer 93. Here, since the frit component of the partition is partially softened due to the above heat, the partition can be stably fixed to the dielectric layer 93 which is formed of $SiO_2$ as a main ingredient.

Although a method of charging the surface of the photoconductive layer with plus electricity and using a mask having a chromium pattern at the portion on which the partition is to be formed is employed in the above embodiment, a method contrary thereto may be possible. That is, the same result can be obtained by charging the surface of the photoconductive layer with minus electricity and performing the first exposure step using a mask of a chromium pattern at the portion on which the partition will not be formed.

As described above, in the method of fabricating a partition of a plasma display device according to the present invention, since the partition is fabricated in an electrophotography method, the shape of the partition is not deformed and also the time for fabricating the partition is much reduced. For instance, in the case of manufacturing a plasma display device having a 20" substrate, the conventional printing method requires one hour or more whereas the time can be reduced to three minutes or less according to the present invention. Further, as to the deviation value which is defined as the distance that the partition formed in strips deviated from the originally designed position, the conventional technology shows the deviation value of 30 $\mu$m or more whereas it is reduced to 5–7 $\mu$m in the present invention. Thus, the reduced fabricating time and positional deviation of the partition can increase quality of products as well as improvement of productivity.

It is noted that the present invention is not limited to the preferred embodiment described above, and it is apparent that variations and modifications by those skilled in the art can be effected within the spirit and scope of the present invention defined in the appended claims. For example, although the present invention describes only a method for fabricating a partition of a plasma display device, the present invention can be applied to a plasma addressed liquid crystal display (PALCD). That is, the method according to the present invention can be applied as it is to form a partition of the PALCD.

What is claimed is:

1. A method for fabricating partitions of a plasma display device comprising the steps of:

forming a dielectric layer on the surface of a rear substrate having an address electrode;

forming a conductive layer and a photoconductive layer in order on the surface of said dielectric layer;

charging the surface of said photoconductive layer;

exposing said photoconductive layer covered with a mask of a predetermined pattern to ultraviolet rays so that an electrostatic latent image can be formed on said photoconductive layer;

developing the electrostatic latent image by allowing said photoconductive layer, on which the electrostatic latent image is formed, to be in contact with a charged liquid toner layer so that liquid toner can stick to the electrostatic latent image;

drying the toner stuck to the electrostatic latent image and absorbing the toner remaining an area other than the electrostatic latent image;

repeating three times the steps from said step of charging the surface of said photoconductive layer through to said step of drying and absorbing the toner; and burning the rear substrate where partitions are formed.

2. The method for fabricating partitions of a plasma display device as claimed in claim 1, wherein said dielectric layer is formed of silicate having silicon dioxide as a main ingredient.

3. The method for fabricating partitions of a plasma display device as claimed in claim 1, wherein said conductive layer is formed by coating an alcoholic solution including ammonium salt on the surface of said dielectric layer and then drying the same.

4. The method for fabricating partitions of a plasma display device as claimed in claim 3, wherein the thickness of said conductive layer is formed to be 1 $\mu$m.

5. The method for fabricating partitions of a plasma display device as claimed in claim 1, wherein said photoconductive layer is formed by coating a composite including a fluorene-based donor, an anthraquinone-based acceptor, a polyacrylate-based binder, and toluene, and then drying the same.

6. The method for fabricating partitions of a plasma display device as claimed in claim 5, wherein the composition ratio of said fluorene-based donor, said anthraquinone-based acceptor, and said polyacrylate-based binder is at the weight ratio of 5:15:85.

7. The method for fabricating partitions of a plasma display device as claimed in claim 5, wherein the thickness of said photoconductive layer is between 5–6 $\mu$m.

8. The method for fabricating partitions of a plasma display device as claimed in claim 7, wherein said mask is disposed spaced apart about 0.5 mm or less from the surface of said photoconductive layer in said first exposing step.

9. The method for fabricating partitions of a plasma display device as claimed in claim 1, wherein the thickness of said photoconductive layer is between 5–6 $\mu$m.

10. The method for fabricating partitions of a plasma display device as claimed in claim 1, wherein, in repeating said expose ire step three times, a mask having a chromium pattern is used for the first exposing step and the second and third exposing steps are performed without a mask.

11. The method for fabricating partitions of a plasma display device as claimed in claim 1, wherein, in said developing step, liquid toner flowing in a laminar flow state on the surface of an electrode to which current is applied is allowed to be in contact with said photoconductive layer where said electrostatic latent image is formed so that the charged liquid toner is stuck to said electrostatic latent image.

12. The method for fabricating partitions of a plasma display device as claimed in claim 11, wherein the distance between said electrode and said photoconductive layer is kept between 0.5–1 mm.

13. The method for fabricating partitions of a plasma display device as claimed in claim 1, wherein said liquid toner is a composition including frit, that is a mixture of metal oxide, a binder, and a solution.

14. The method for fabricating partitions of a plasma display device as claimed in claim 13, wherein said liquid toner is formed by mixing said frit and said binder at 3:7 weight ratio and by mixing a mixture of said frit and said binder with said solution at the weight ratio of 1:20.

15. The method for fabricating partitions of a plasma display device as claimed in claim 14, wherein said binder is polymetacrylic acid and said solution is isoparaffin liquid.

16. The method for fabricating partitions of a plasma display device as claimed in claim 14, wherein said frit of said liquid toner includes different metal oxide components each repeated time of said three-time repetition steps, i.e., said frit of the liquid toner includes lead oxide, manganese oxide, and zinc oxide for the first repetition, lead oxide, copper oxide, manganese oxide, and chromium oxide for the second repetition, and lead oxide, di-boron trioxide, and aluminum oxide for the third repetition.

17. The method for fabricating partitions of a plasma display device as claimed in claim 16, wherein said frit of said liquid toner for the first repetition includes lead oxide, manganese oxide, and zinc oxide of 30:40:30 wt %.

18. The method for fabricating partitions of a plasma display device as claimed in claim 16, wherein said frit of said liquid toner for the second repetition includes lead oxide, copper oxide, manganese oxide, and chromium oxide of 30:25:30:15 wt %.

19. The method for fabricating partitions of a plasma display device as claimed in claim 16, wherein said frit of said liquid toner for the third repetition includes lead oxide, di-boron trioxide, and aluminum oxide of 35:25:40 wt %.

20. The method for fabricating partitions of a plasma display device as claimed in claim 13, wherein said binder is polymetacrylic acid and said solution is isoparaffin liquid.

21. A plasma display device fabricated by forming a dielectric layer on the surface of a rear substrate having an address electrode, forming a conductive layer and a photoconductive layer in order on the surface of said dielectric layer, charging the surface of said photoconductive layer, exposing said photoconductive layer covered with a mask having a predetermined pattern to ultraviolet rays so that an electrostatic latent image can be formed on said photoconductive layer, developing the electrostatic latent image by allowing said photoconductive layer, on which the electrostatic latent image is formed, to be in contact with a charged liquid toner layer so that liquid toner can stick to the electrostatic latent image, drying the toner stuck to the electrostatic latent image and absorbing the toner remaining an area other than the electrostatic latent image, repeating three times the steps from said step of charging the surface of said photoconductive layer through to said step of drying and absorbing the toner, and burning the rear substrate where partitions are formed.

22. The plasma display device as claimed in claim 21, wherein said liquid toner is a composite including frit, that is a mixture of metal oxide, a binder, and a solution, said frit of said liquid toner includes different metal oxide components each repeated time of said three-time repetition step, and a completed partition has different thermal expansion coefficients according to its height so that the difference of amount of deformation due to thermal expansion can be accommodated.

* * * * *